United States Patent [19]

Cohen

[11] 4,261,474

[45] Apr. 14, 1981

[54] FILTER DEVICE FOR INJECTABLE FLUIDS

[76] Inventor: Milton J. Cohen, 10823 Burbank Dr., Potomac, Md. 20854

[21] Appl. No.: 90,428

[22] Filed: Nov. 1, 1979

[51] Int. Cl.[3] ..... B65D 41/20

[52] U.S. Cl. ..... 215/250; 128/272.3; 215/247; 215/308

[58] Field of Search ..... 215/247, 248, 249, 250, 215/308; 206/221; 128/272.1, 272.3

[56] References Cited

U.S. PATENT DOCUMENTS

| | | | |
|---|---|---|---|
| 1,115,597 | 11/1914 | Sherman | 215/247 |
| 2,186,888 | 1/1940 | Tullar | 215/248 |

*Primary Examiner*—Donald F. Norton

*Attorney, Agent, or Firm*—McDougall, Hersh & Scott

[57] ABSTRACT

A filter device for injectable fluids which includes a tubular member secured in sealing relation in the open end of a vial partially filled with the injectable fluid and a rupturable sealing disc sealing the tubular member and which includes a filter means within the tubular member for filtration of fluid during passage through said tubular member.

5 Claims, 2 Drawing Figures

FILTER DEVICE FOR INJECTABLE FLUIDS

This invention relates to an injectable fluid system which makes use of a filter device for fluid storage wherein removal of undesirable particulates is effected while the fluid is being taken up by a syringe for injection.

In my copending application Ser. No. 59,670, filed July 23, 1979, and entitled "Filter Device for Injectable Fluid", description is made of a vial which is open at one end and partially filled with the injectable fluid. The open end of the vial is sealed by a rupturable sealing disc adapted to be pierced by the needle of the syringe into which the fluid is to be withdrawn from the vial for injection in the usual manner. A container, in the form of a tubular member, is provided in the neck portion of the vial, with the container being divided into two adjacent compartments each of which is provided with a filter which must be penetrated by any fluid or gas passing into and out of the vial. The compartments are closed at their bottom sides by self sealing members one of which opens in response to pressure differential between one compartment and the interior of the vial when the pressure in the compartment is greater than the pressure in the vial, and the other of which is opened when the pressure in the other compartment is less than the pressure in the vial.

Thus, when the syringe needle is inserted into the one compartment and the plunger of the syringe is depressed, air is forced from the syringe into the one compartment, and through the filter, into the vial to pressurize the interior of the vial with filtered air. Thereafter, the vial is inverted and the needle of the syringe is inserted through the sealing disk into the other compartment. In response to withdrawal to the plunger, a vacuum is introduced into the other compartment which, with the aid of the air pressure within the vial, causes the liquid in the vial to flow through the filter and into the other compartment for withdrawal of filtered fluid from the vial into the syringe for injection.

It has been found, in accordance with the practice of this invention, that the desired results for maintaining sterile conditions can be achieved by the use of a filter device which is much simpler in construction and easier in operation thereby to reduce the cost of the device as well as its utilization in making filtered fluid available to the syringe for injection, and it is an object of this invention to provide a device of the type described for use in the storage of an injectable fluid under sanitary conditions and for transfer of filtered fluid to an injection device in a manner to avoid contamination of the fluid.

Figure 1:
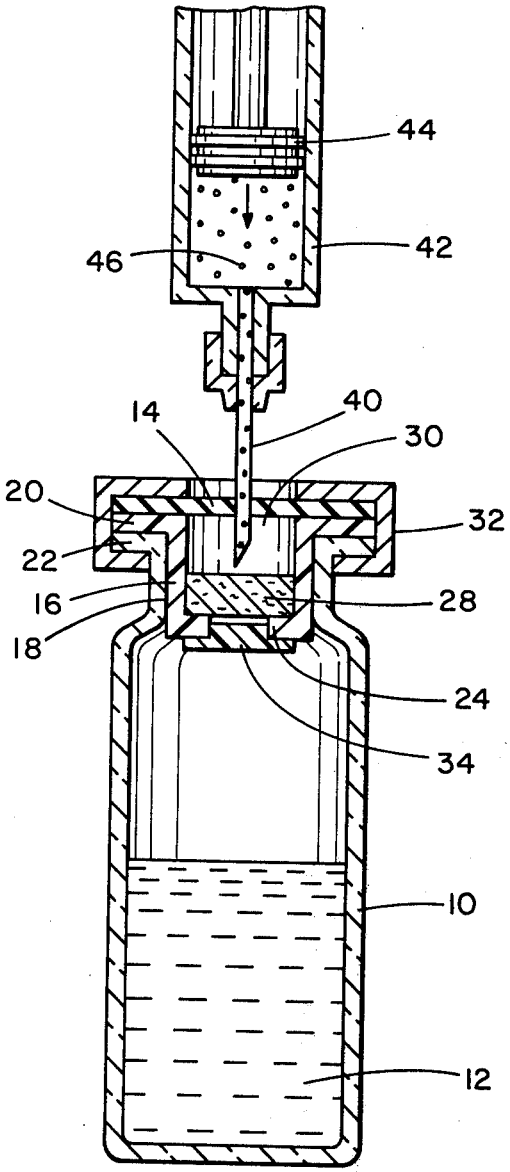
Figure 2:
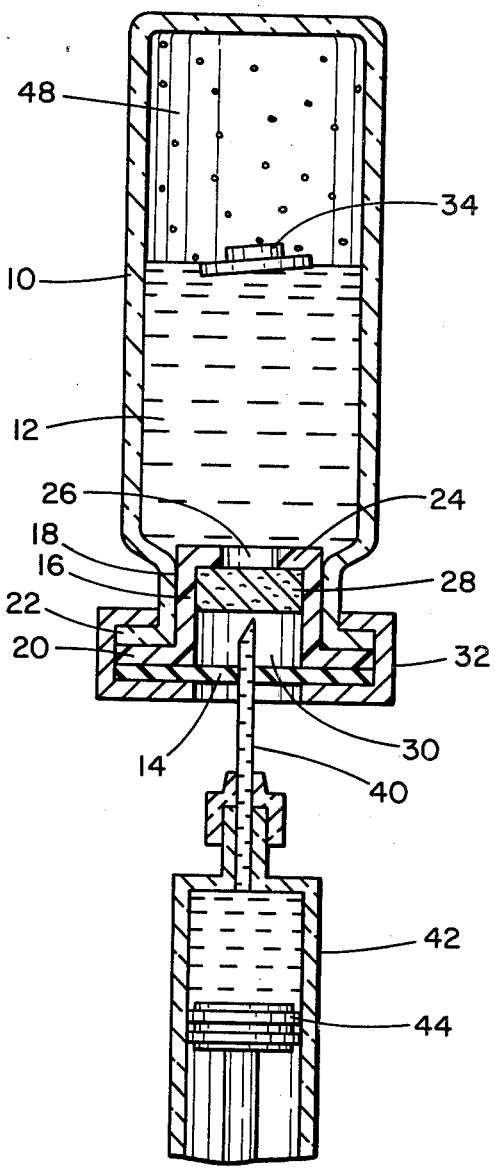

These and other objects of this invention will hereinafter appear and for purposes of illustration, but not of limitation, an embodiment of the invention is shown in the accompanying drawing in which:

FIG. 1 is a sectional elevational view of the filter device of this invention shown with the needle of the syringe in position for pressurizing the interior of the vial; and FIG. 2 is a sectional elevational view of the elements shown in FIG. 1 in position for withdrawal of filtered fluid from the vial into the syringe.

The device embodying the features of this invention comprises a glass, plastic or the like vial 10 which is adapted to be partially filled with a liquid 12 to be injected. The liquid is maintained in sealing relation within the vial by means of a rupturable sealing disc 14, such as formed of rubber, plastic, or the like fluid and vapor impervious material.

A tubular member 16, which is open at the top and at the bottom, is dimensioned to be received in fitting relation within the neck 18 of the vial 10, with an annular flange 20 extending perpendicularly outwardly from the upper open end of the tubular member to overlie the lip 22 at the open end of the vial. The lower open end of the tubular member 16 is provided with an annular flange 24 extending inwardly a short distance to define a central opening 26 communicating the interior of the vial 10 with the interior of the tubular member 16.

The interior of the tubular member is provided with a filter element 28 which is retained therein in sealing relation to insure filtration of any liquid or gas passing through the tubular member. In the illustrated modification, the filter member 28 is in the form of a disc member dimensioned to have a thickness less than the length of the tubular member to provide an open space 30 between the filter member 28 and the open upper end of the tubular member.

A rupturable disc 14 is secured in sealing relation onto the open end of the vial 10 by means of a crimp cap 32 which embraces the portion of the sealing disc 14 overlying the lip 22 and with the annular flange 20 of the tubular member in between, whereby the elements are secured onto the open end of the vial in sealing relation.

A stopper 34, formed of rubber, plastic or the like, is dimensioned to be received in the opening 26 communicating the interior of the tubular member with the interior of the vial, to plug the opening when in position of use.

In use, the vial 10 is partially filled with the injectable liquid 12 and the plugged tubular member and sealing disc are secured by the crimp cap 32 in sealing relation at the open end of the vial.

When it is desired to effect removal of injectable fluid from the vial into a syringe for injection or otherwise, the needle 40 of the syringe 42 is inserted through the sealing disc 14 into the open space 30 of the tubular member, above the filter disc 28. Thereafter, the plunger 44 of the syringe is displaced in the direction to force air 46 from the syringe into the tubular member 16. In response to the air pressure, the plug 34 is unseated from the opening 26 to enable the pressurized air to flow through the filter and into the interior of the vial whereby the filtered air is forced into the vial to build up pressure therein.

Thereafter, the entire unit is inverted to position the vial 10 above the syringe 42 whereby the void space 48 in the vial, filled with pressurized air, is uppermost while the liquid 12 to be injected is in the lower portion of the vial in communication with the filter 28. When the plunger 44 is withdrawn to displace the piston plug 44 in the syringe, a vacuum is created in the syringe and in the tubular member connected by the needle to the syringe whereby, in combination with the internal pressure of the filtered air in the vial, the liquid 12 is caused to flow from the vial, through the filter 28 for flow of filtered fluid from the tubular member through the needle to the interior of the syringe for subsequent injection from the syringe. Thereafter the syringe, now filled with fluid under sterile conditions, can be withdrawn from the device for subsequent dispensing of the injectable liquid.

It will be apparent that the desired flow paths are achieved, in accordance with the practice of this invention, under conditions that prevent contamination of the liquid in that the air or gas introduced into the interior of the vial is pressurized and filtered before entry into the vial, and the liquid flowing from the vial into the syringe is filtered to remove any contaminants or particulates before entry into the syringe. One of the notable improvements in the utilization of a device of the type described is the elimination of the need for inclusion of a filter element in the syringe through which an injectable fluid will have to be forced in utilization of the syringe. Such elimination of the need for a filter element in the syringe provides for greater flexibility in utilization of the syringe and greater ease and safety in the operation thereof.

It will be understood that changes may be made in the details of materials, in the construction, and in the operation of the device without departing from the spirit of the invention, especially as defined in the following claims.

I claim:

1. A filter device for injectable fluids comprising a vial open at one end and partially filled with the injectable fluid, a rupturable sealing disc, a tubular member open at both ends extending into the open end of the vial, means securing the sealing disc and the tubular member in sealing relation to the open end portion of the vial, a passage in the tubular member communicating the interior of the tubular member with the interior of the vial, a stopper releasably fitted in said passage to plug the passage, and a filter means within the tubular member for filtering fluid or gases during flow through the tubular member.

2. A filter device as claimed in claim 1 in which the vial has a lip portion about the open end and the tubular member and sealing disc have annular portions which are dimensioned to overlie the lip portion, and means for securing said overlying portions onto the lip to effect a sealing relation therebetween to seal the open end of the vial.

3. A filter device as claimed in claim 2 in which the annular portion of the tubular member is disposed between the annular portion of the sealing disc and the lip in the assembled relation.

4. A filter device as claimed in claim 1 which includes an annular flange extending inwardly from the inserted end portion of the tubular member to define the passage communicating the interior of the tubular member with the interior of the vial.

5. A filter device as claimed in claim 4 in which the filter means comprises a filter disc which spans the passage and is seated in the tubular member in engagement with the annular flange.

* * * * *